US008752776B2

(12) United States Patent
Dean et al.

(10) Patent No.: US 8,752,776 B2
(45) Date of Patent: Jun. 17, 2014

(54) APPARATUS AND METHOD FOR THE PROCESSING OF CELLULOSE FIBRES

(75) Inventors: Trevor W. R. Dean, Buckinghamshire (GB); Karnik Tarverdi, Middlesex (GB); Robert Bramsteidl, St. Agatha (AT); Luca Achilli, London (GB)

(73) Assignee: BASF SE, Ludwigshefen (DE)

( * ) Notice: Subject to any disclaimer, the term of this patent is extended or adjusted under 35 U.S.C. 154(b) by 64 days.

(21) Appl. No.: 13/508,321

(22) PCT Filed: Nov. 5, 2010

(86) PCT No.: PCT/GB2010/051852

§ 371 (c)(1),
(2), (4) Date: Dec. 14, 2012

(87) PCT Pub. No.: WO2011/055148

PCT Pub. Date: May 12, 2011

(65) Prior Publication Data

US 2013/0192776 A1 Aug. 1, 2013

(30) Foreign Application Priority Data

Nov. 5, 2009 (GB) ..... 0919422.6

(51) Int. Cl.

| | |
|---|---|
| ***B02C 1/00*** | (2006.01) |
| ***B02C 17/00*** | (2006.01) |
| ***B02C 19/22*** | (2006.01) |

(52) U.S. Cl.
USPC ..... 241/21; 241/24.19; 241/260.1

(58) Field of Classification Search
USPC ..... 241/21, 260.1, 261, 24.19, 24.29
See application file for complete search history.

(56) References Cited

U.S. PATENT DOCUMENTS

| | | | | |
|---|---|---|---|---|
| 4,284,247 | A * | 8/1981 | Eriksson | 241/260.1 |
| 4,732,335 | A | 3/1988 | Eriksson | |
| 6,120,648 | A * | 9/2000 | Scott et al. | 162/261 |
| 6,379,594 | B1 * | 4/2002 | Dopfner et al. | 264/28 |

FOREIGN PATENT DOCUMENTS

| | | |
|---|---|---|
| DE | 1180349 | 10/1964 |
| DE | 2916754 | 11/1979 |
| EP | 0979895 | 2/2000 |

* cited by examiner

*Primary Examiner* — Faye Francis
(74) *Attorney, Agent, or Firm* — Head, Johnson & Kachigan, P.C.

(57) ABSTRACT

The invention according to the present invention relates to the manufacture of paper and or boards and/or binding agents and a method and apparatus related to the same by providing for the defibrillation of cellulose fibers into a form in which the same can be subsequently sued to form the finished product directly or can be used to bind other materials together and then be formed into the finished product. The apparatus includes a twin screw conveyor through the material and liquid passes to be processed.

6 Claims, 3 Drawing Sheets

APPARATUS AND METHOD FOR THE PROCESSING OF CELLULOSE FIBRES

Figure 1:
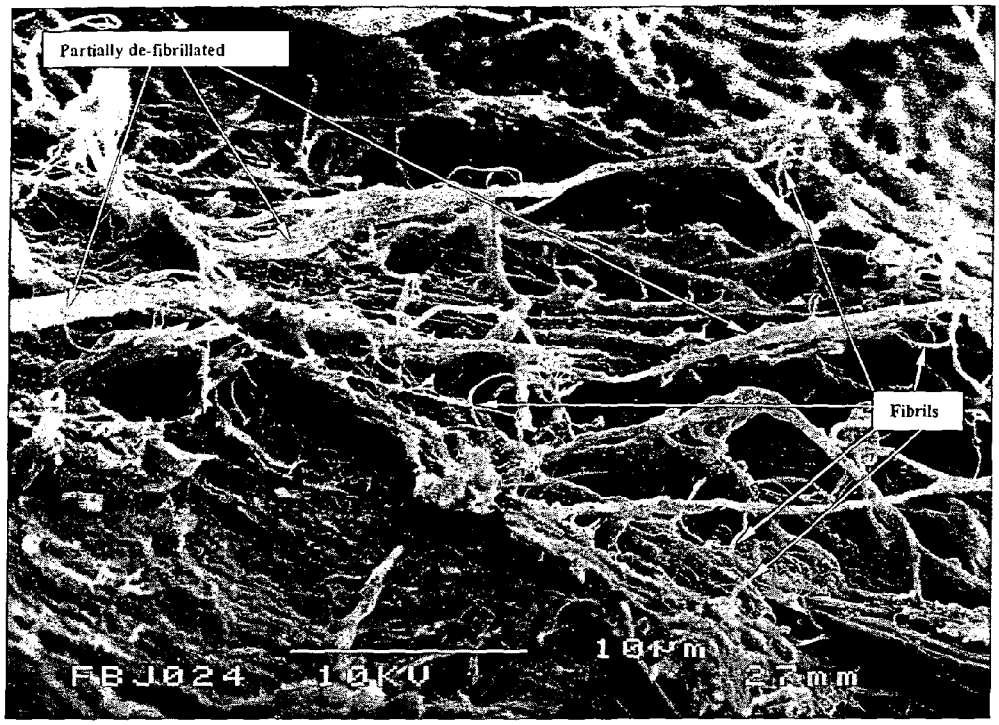

The invention according to the present invention relates to the manufacture of paper and or boards and/or binding agents and a method and apparatus related to the same.

The treatment of compositions comprising cellulose fibres into compositions comprising de-defibrillated cellulose fibres for paper making purposes is known. A composition comprising de-fibrillated cellulose fibres obtained by the method according to the invention can now economically be used in producing a wide range of paper and board products, for example, absorbent papers, newsprint, printings and writing, laminating bases, packaging papers such as fluting, liners and carton board.

Processes for opening, beating or defibrillating pulp fibres to obtain fibrillation, increased surface area, increased accessibility and fine particle size have long been known. Ball mills are used for preparing cellulose of several tens of microns in dimension. Studies have indicated that such ball milling breaks the chemical bonds of the cellulose during the dividing process.

It is also known to grind cellulose in water under pressure to produce a micro-cellulose with a particle size of less than one micron. In the case of cellulose derivatives, cold milling of the derivatives in liquid nitrogen is also disclosed in the prior art. Sonic pulverization with a ball mill is also a known method of producing cellulose in extremely fine particle size.

Finely divided celluloses are also produced in the traditional processes used in manufacturing fibreboard and paper pulp. Normally, however, these traditional processes involve the use of additional chemical treatment to cellulose pulps, as for example, acid hydrolysis, which chemically alter or degrade the prepared cellulose pulps.

In the paper industry, it is known that paper strengths are directly related to the amount of beating or refining which the fibres receive prior to formation. However, beating and refining as practiced in the paper industry are relatively inefficient processes and large amounts of energy are expended to gain relatively minor amounts of fibre opening and fibrillation.

GB2066145 describes a process for preparing micro-fibrillated cellulose, comprising passing a liquid suspension of fibrous cellulose through an orifice in which the suspension is subjected to a pressure drop of at least 3000 psi and a high velocity shearing action followed by a high velocity decelerating impact and repeating the passage of said suspension through the orifice until the cellulose suspension becomes a substantially stable suspension. The process converts the cellulose into micro-fibrillated cellulose without substantial chemical change. A particularly suitable device for carrying out the process is a high pressure homogenizer. The liquid suspension comprising fibrous cellulose preferably contains no more than 10% by weight of cellulose.

EP0402866 describes micro-fibrillated material comprising fibres having a variety of thicknesses, having a Schopper's Riegler of 40° SR or greater when the fibres are formed in a filter sheet. The materials are obtained using a high-pressure homogenizer. For example, it is described that using refined linter (Vackai HVE) as a raw material, a 2% suspension of cellulose in water is obtained by pre-treatment so that it can pass through the nozzle of the apparatus. The suspension is charged into a high-pressure homogenizer (Gaulin 15M-8TA) at ordinary temperature, and treated at a pressure of 500 kg/cm$^2$ G for four times. The resultant suspension of micro-fibrous material is diluted to a concentration of 0.2%.

U.S. Pat. No. 6,379,594 describes a process for producing a work piece, comprising providing raw cellulose-containing and fibrous material; adding water to the raw material; finely chopping the raw material in a machine by continuously grinding the raw material with a total energy expenditure of at least 0.5 kWh/kg, based on dry weight of the raw material, into a microfiber pulp having an increased internal fibre surface and an increased degree of interlinking; forming the microfiber pulp to provide a shaped body; and drying the body by removing water there from to harden and form a work piece, without admixture of bonding agents to the microfiber pulp and without use of external pressure. In this way, a mouldable microfiber pulp with very diverse fibre lengths and fibril sizes develops, which pulp has the characteristic of hardening to form a subsequently deformable fibre material with high density (up to a specific gravity of 1.5) and strength without the admixture of adhesives or chemical additives and without the use of pressure, through drying and the associated shrinkage. The examples disclose that the cellulose-containing materials used in the method are taken up in watery solutions with a dry substance between 5 and 8% by weight.

However, the above processes have only limited application as the materials obtained have the disadvantage of requiring high energy input to be efficient, relatively low consistency (3-15% is usual) and significant processing time if SR values above 50° are required. It is therefore an object of the current invention to provide for a more economically and environmentally friendly method for providing compositions comprising refined cellulose fibres, for example comparable to those described in U.S. Pat. No. 6,379,594.

The current invention relates to a method and apparatus for the manufacture of paper, including the refining of cellulose fibres, achieved through single or multiple passes of a pre-processed cellulose fibre suspension in water (paper making term 'stock') with a preferred solid material consistency range of 35-60% through processing apparatus.

The difference between pulping and defibrillation should also be appreciated. In pulping, lignin is removed from lignocellulosic materials to render the fibres suitable for paper and board making. In defibrillation the purpose is to raise a nap of individual fibrils making up the outer surface or wall of the fibre whilst, at the same time, attempting to maintain both the condition of the interior of the fibre and the fibre length.

Methods and apparatus for the manufacture of paper are known and have been used as indicated above for many years. However, the paper making industry has been, conventionally, a relatively slow moving industry in terms of new development. Part of the paper making process as already described, requires the fibrillation of fibres to raise or detach fibrils from the main body of the, typically cellulose fibres, thereby increasing the effective bonding area thereby encouraging more bonding between the cellulose fibres and hence allow the formation of the paper once wetted and dried. Originally the process was undertaken by the beating of the fibres by hand or in a water-powered stamping mill in order to promote subsequent bonding of the fibres. Subsequently, a machine known as a Hollander beater was used in place of manual labour. However, even this apparatus was slow and subsequently, refining apparatus has been used including rotating plates with bars, which operate at a quicker speed then the previous apparatus but has a disadvantage in that it is required to be operated with relatively dilute suspensions of the fibres which means that a large quantity of liquid subsequently needs to be handled in this refining stage. This, in turn, means operation of the apparatus is required for a greater period of time and hence greater energy usage. In turn, this has meant that the costs involved in the manufacture of paper have increased to such an extent that, in certain, countries where energy is expensive, the manufacture of paper has almost ceased and led to paper being imported from countries where the energy required in the manufacturing process is cheaper.

The aim of the present invention is therefore to provide apparatus and a method which allows a material which can be provided for subsequent use, such as for quality paper, or as a binding agent to be manufactured while, at the same time, reducing the liquid which is required to be used in the suspension and, in turn, reduce the requirement for energy usage in the refining (or beating) process.

In a first aspect of the invention there is therefore provided apparatus for the manufacture of a material for a subsequent use wherein said apparatus includes a conveyor with twin screws through which cellulose fibres and liquid pass during the manufacturing process to allow the formation of a material including cellulose microfibers for subsequent use.

In one embodiment the subsequent use is to form paper or board.

In another embodiment the subsequent use is to act as a bonding agent for the bonding of other materials and/or fibres together to form a finished product.

Typically the twin screws are provided in the apparatus in a form and configuration so as to extrude the fibres and liquid from the apparatus.

In one embodiment the apparatus includes an inlet at a first end for the introduction of the cellulose fibres and/or liquid in which said fibres are contained, an outlet at an opposing end via which the defibrillated fibres leave and intermediate the inlet and outlet, there are provided on said twin screw conveyor at least one cluster of refining members and one means of flow restriction.

In one embodiment there are provided a plurality of refining clusters along the length of the conveyor, said clusters separated by flow restriction means. In one embodiment there can be provided clusters of flights which act to transport the material along the screw, said clusters typically being provided between the flow restriction means.

In one embodiment the elements of the twin screw conveyor at the refining clusters act as kneading elements to perform a kneading action on the fibres.

In one embodiment the means of flow restriction is a series of spiral screw elements formed on the twin screw conveyor which reduce the speed of flow of the material through the conveyor.

In one embodiment the screw elements of the conveyor are tri- or bi-lobal, but preferably tri-lobal in order to provide improved refining or defibrillating efficiency.

Typically, during this processing operation, fibre slurries are optionally further enhanced with additional fibre and mineral additives to optimise performance of the material for specific end purposes.

Typically, the refined fibre slurry produced from the apparatus of the invention is defined as one reaching a Schopper-Riegler (SR) level suitable for the particular grade of paper or board or use as a bonding agent being manufactured and would normally lie between 18° SR (examples absorbent papers such as some tissues and wipes) through to 75° SR (tracing and greaseproof papers, cigarette tissue).

Advantages of the process are significant energy and time savings based on plate refiner based methods previously employed, higher comparable output, at a consistency range of between and including 35 and 60%. Consistency' is a paper making term and refers to the amount of dry fibre in a water suspension expressed as a percentage. This aqueous suspension of fibre in water is commonly called 'stock' in the pulp and paper industry It has been found by the current inventors that the above mentioned disadvantage(s) of traditional beating or refining methods are overcome by the method, compositions and use according to the current invention.

The invention relates to processes and technology for the production of refined cellulose fibres, which can be used directly as a basis for paper and board forming processes, can become a component in hybrid materials such as when the refined cellulose fibres are used as bonding agents for other fibres or materials, can be moulded into shapes for packaging (egg boxes, fruit trays, packing delicate electronic equipment, etc.) Therefore, typical industry end uses include, but are not confined to, paper and board manufacturing, flexible filter membranes, interior board products (decorative and industrial laminates), automotive industry (oil filter paper), lighting (lampshade parchment), disposable consumer goods (toilet and facial tissues, domestic and industrial wipes), casings and packaging.

Some of the advantages of the invention concern, reduced energy requirement in comparison to those methods known to the applicant, a wide variety of options for the raw materials that can be used in the method according to the invention, and an increased consistency and reduced processing time.

In a further aspect of the invention there is provided a method for defibrillating cellulose fibres, achieved through single or multiple passes of a raw or pre-processed cellulose fibre slurry, with a preferred solid material consistency range of 35 to 60%, through apparatus in the form of a co-rotating twin screw machine.

In one embodiment, the option of using a counter-rotating twin screw device as a feeding system is provided. During this processing operation, fibre slurries can be optionally further enhanced with additional fibre and mineral additives to optimise performance of the material for specific end purposes. Advantages of the process are significant energy and time savings based on plate refiner based methods previously employed in the art, higher comparable output, and a consistency range of between 10 and 80% and more typically 35-60%.

In a further aspect of the invention, there is provided a method for the treatment of a composition comprising cellulose fibres into a composition comprising cellulose microfibers characterized in that the method comprises the steps of:

a) Providing a composition comprising cellulose fibres;
b) Admixing aqueous solvent to said composition comprising cellulose fibres to provide a pulp suspension comprising cellulose fibres;
c) Feeding said pulp suspension comprising cellulose fibres into a refining step comprising a mechanical refining process executed using a refining twin screw;
d) Refining said pulp suspension comprising cellulose fibres with at least the use of said refining twin screw, to provide a composition comprising refined cellulose fibres; and wherein said obtained composition comprising refined cellulose fibres at the end of the refining step is suitable for conversion into a paper or board.

In one embodiment the particular paper of a wide range of papers and boards, is selected and the fibre solvent mixture is selected accordingly.

Refining, or beating, is the mechanical action which causes de-fibrillation. This treatment of the said pulp suspension comprising cellulose fibres by said refining twin screw (with energy consumptions as shown in the Examples) provides a composition comprising refined cellulose fibres; and wherein said obtained composition comprising refined cellulose fibres at the end of the refining step has a given Schopper-Riegler value with lower energy input/energy costs in comparison to those methods described in the art.

Within the context of the current invention "materials comprising cellulose fibres" comprise any suitable material, for example, and not limited to paper, recycled paper, and lignocellulosic fibre sources including, but not confined to pulps made from hardwoods and softwoods, cotton linter, hemp stems, flax stems cereal straws (wheat, barley, rye, oats and rice, abaca, bagasse, bamboo, wood waste and cotton waste). As will be understood by the skilled person, the presence of fibres and associated fibrils are an essential part of any suitable material.

It will be understood by the skilled person that such materials may be pre-treated before being applied in the method according to the invention. Such pre-treatment may include removal of toxic or unwanted materials, chopping, hammer milling or pinning of the material, washing, and chemical treatments either singly or combinations thereof.

For example, pre-treatment may comprise the use of a paper shredder with interchangeable hammer mill linked to extraneous (contrary) material separation (wood, metal, stones, plastic, etc) and a cleaning system, including dust removal (all known to the skilled person).

In a next step of the method, the composition comprising cellulose fibres is (and preferably while being subjected to disintegration in the feeding system) being mixed with an aqueous solution, including tap water or deionised water with or without the addition of steam. Said mixing can for example be performed by dry feeding the composition comprising cellulose fibres into a twin screw machine.

As will be understood by the skilled person, if required, the aqueous solution may comprise additional materials, for example additives such as described below (but not limited to):

Wetting agents to accelerate water penetration into the raw material and/or starches and similar material used to modify the properties of the end product.

The mixing with the aqueous solution/liquid may be performed by any means known to the skilled person, however preferably, preparing the pulp is achieved by feeding the composition comprising cellulose fibres to a first twin screw (preferably counter-rotating) that is fitted with a water (or steam) feed system, preferably a metered water feed system. In the twin screw the liquid and the composition comprising cellulose fibres are processed into a crumb suitable for feeding into the following refining stage. Preferably the counter rotating twin screw employed in the feeding step of the method is fitted with a water and/or steam inlet with the objective of softening (lubricating) the fibres thereby minimising fibre damage.

In general, for the fibre treatment and refining procedures, a co-rotating twin screw apparatus can be used at a speed of 250 RPM and a set temperature of about 50° C., but this temperature and screw speed can be varied according to the fibres being treated, depending on the liquid addition rate and necessity. The consistency of the pulp can be varied from 10 to 80% and more typically 35-60% solids content, which is advantageous in comparison to the methods described in the art, in which the use of much lower consistencies has been reported in traditional processes to prepare refined cellulose fibres within, for example, the pulp, paper and board making industries In a preferred embodiment of the method according to the invention, the pulp suspension provided in step b) is provided with a consistency of at least 30%; and preferably between, and including 40% and 60%. The consistency value is chosen to give the fibre characteristics required for the end product It has surprisingly been found that by providing a pulp suspension with a consistency of at least 30%, and preferably between and including 40% and 60%, the method according to the invention can be performed in a highly economical fashion, reducing energy requirement in the production of the material as well as reducing the processing time and reducing the amount of processing water.

It is noted that this is in strong contrast to the methods known in the art. For example, U.S. Pat. No. 6,379,594 describes the use of cellulose-containing materials in the method described therein, taken up in watery solutions with a dry substance between 5 and 8% by weight.

In a next step of the method according to the invention, the obtained pulp suspension comprising cellulose fibres is fed into a refining step comprising a mechanical de-fibrillation process executed using a refining twin screw and refining said pulp suspension comprising cellulose fibres with at least the use of said refining twin screw, to provide a composition comprising refined cellulose fibres with properties such as fibre length, refining degree (°SR), drainage and bonding properties.

Although the skilled person will understand that various twin screw configurations can suitably be used in the method according to the invention, a twin screw configuration as described in the examples below can be used.

During the operating of the twin screw, the cellulose fibres, made up of layers of micro-fibres called fibrils, are refined so that the fibrils are partially de-fibrillated/unravelled from the parent fibre thus creating a greater number of potential bonding sites, thereby promoting hydrogen bonding between the fibres and/or fibrils. This action is well-known as de-fibrillation, and can be witnessed from the photomicrograph in FIG. 1 and FIG. 2.

In certain embodiments, the refining twin screw is a co-rotating or counter rotating twin screw. In addition, it has been found that by the use of a twin screw, materials of higher consistency than those reported in the art can advantageously be utilized, as described herein. Moreover, there is a significant reduction in processing time in comparison to, for example, the method described in U.S. Pat. No. 6,379,594 (from hours to minutes when expressed at the time required for obtaining equal amounts of a composition comprising micro-fibres), as well as a reduction on energy consumption.

It will be appreciated by the skilled person that based on the teaching disclosed herein; he will be capable of determining the proper operational parameters for obtaining a composition comprising a chosen mixture of refined cellulose fibres with a range of characteristics suitable for the particular desired end product.

The material thus obtained can suitably be used in subsequent steps of the method according to the invention for the production of, but not limited to, paper and board forming processes, can become a component in hybrid materials, can be moulded into shapes for packaging (egg boxes, fruit trays, packing delicate electronic equipment, etc.) Therefore, typical industry end uses include; but are not confined to, paper and board manufacturing, flexible filter membranes, interior board products (decorative and industrial laminates), automotive industry (oil filter paper), lighting (lampshade parchment), disposable consumer goods (toilet and facial tissues, domestic and industrial wipes), casings and packaging.

In another preferred embodiment there is provided that the composition comprising refined cellulose fibres has a Schopper-Riegler value (SR), preferably measured in accordance with the method described in detail in Example 2, of between 18 and 75°, depending upon the requirements of the end product.

By the method and use of apparatus according to the invention, it is now possible to provide for a range of paper and board making stocks and the manufacture of bonding agent material in a manner that is both economically and environmentally advantageous as well as time saving.

The traditional refining operation in the paper and board industries is carried out in the consistency range 4-8% which means that vast quantities of water must be pumped around the mill refining system. For special fibre applications, refining is carried out at up to 35% consistency but this is where special fibre characteristics are required for sack kraft i.e. the fibres are given a twist which increases the stretch properties of the final paper. The twin screw refines more efficiently above 35% consistency and the process defibrillates the fibres as required by paper and board manufacturers to promote fibre-to-fibre bonding rather than merely imparting a twist.

The reduced amount of water usage is also of benefit in countries where water supply is limited.

It is possible to modify the fibre as it is being refined by the addition of chemicals, as the amount of liquid used is relatively low.

In one embodiment of the invention there is provided a method and apparatus by which Ligno-cellulosic materials can be efficiently processed (de-fibrillated) using a twin screw conveyor system with solids content between 50 and 60% to give a material which has a Schopper-Riegler value lying between 35 and 75°.

In one embodiment this processed material can subsequently be used to form a finished product or, alternatively to be used as a binding or bonding agent provided as a part of a finished product. In one embodiment the processed material is used to bind finely divided, non-processed ligno-cellulosic material together and be formed into, a finished article such as flat boards or 3-dimentional objects as a result of the application of heat and/or pressure thereto.

In one embodiment the ratios of processed to unprocessed ligno-cellulosic materials range from 5/95 to 95/5.

In a further embodiment the processed ligno-cellulosic material can be used to bind conventional filler materials such as talc, calcium carbonate and/or china clay as well as fine sand, powdered glass, powdered charcoal and finely divided inorganic and organic pigments.

In this embodiment the preferred ratio of the processed ligno-cellulosic material to pigment or filler is provided in the range of 70/30 to 30/70.

Figure 2:
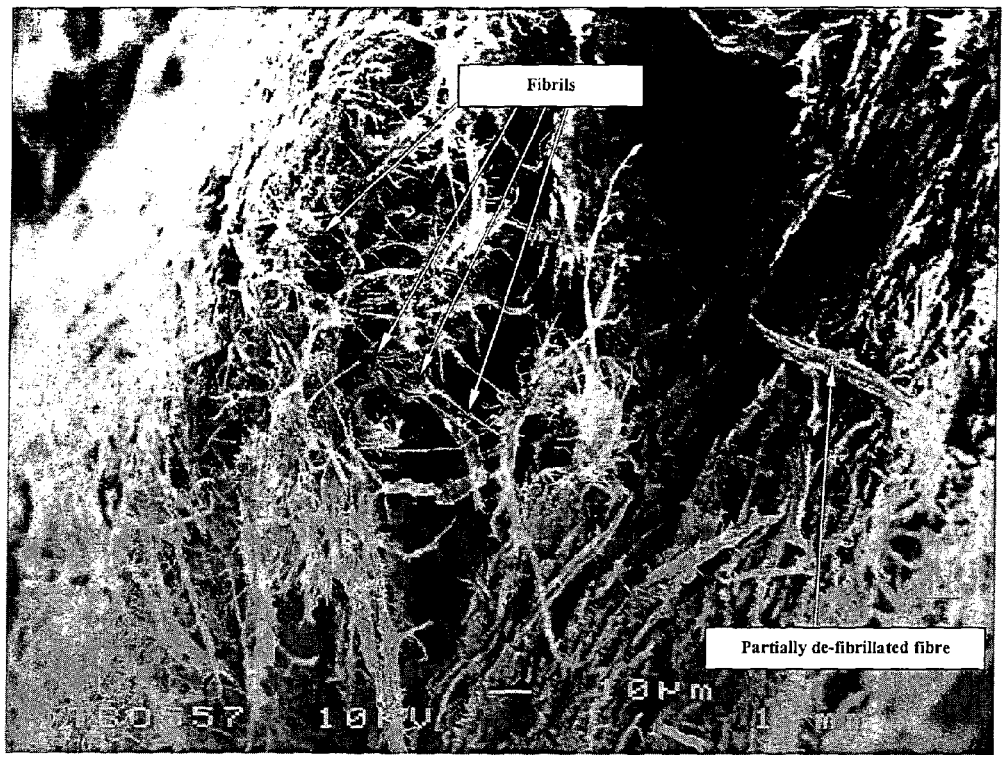
Figure 3:
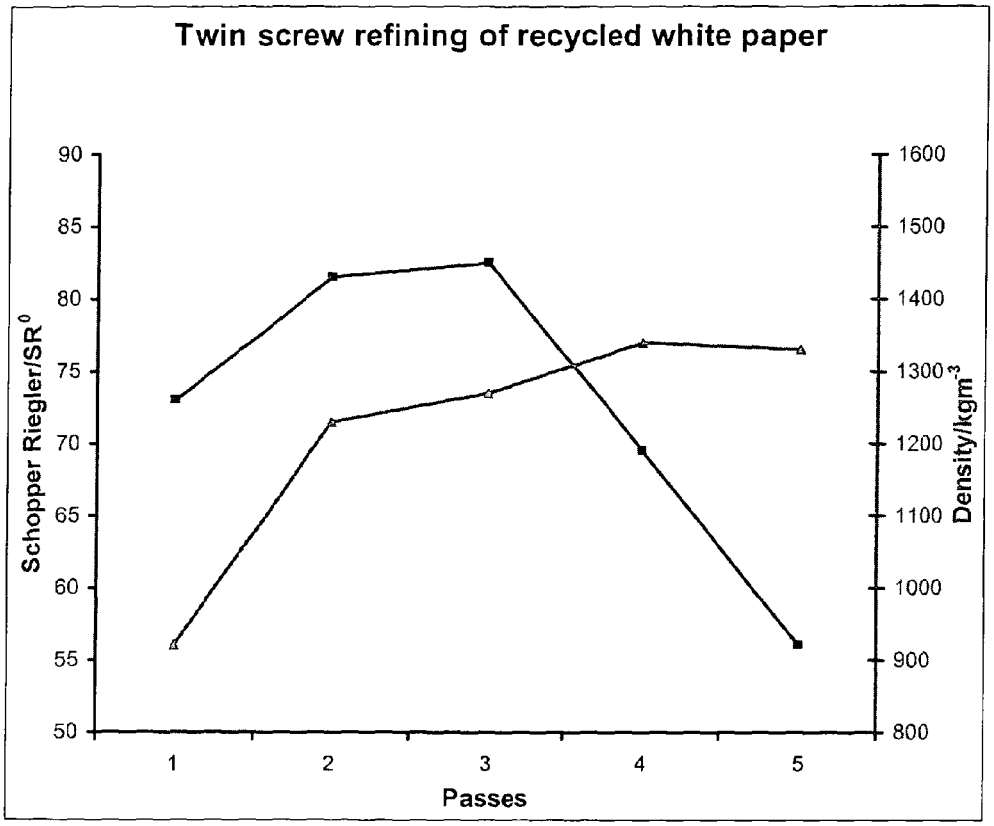

Specific embodiments of the invention are now described with reference to the accompanying drawings; wherein FIG. 1 illustrates an SEM image of hemp fibres, defibrillated to a high degree FIG. 2 illustrates an SEM image of hemp fibres, defibrillated to a high degree and FIG. 3 illustrates the SR and density curve of co-rotating twin screw refined white waste paper material. This highly refined material has a "broad" SR range of between 60 and 90 SR and a "broad" density range of between 850 and 1450 $kgm^3$. The square points relate to the Schopper Reigler graph and the triangular points relate to the Density graph The following procedure describes how the Schopper-Riegler (SR) test is performed on pulp stock suspensions. For the purpose of the experiments described herein the pulp stock suspension is achieved by adding a specific amount of tap water to the refined material coming out of the co-rotating twin screw apparatus. The details of the pulp stock suspension preparation are described in the test method section below. The test measures the rate of water drainage from the pulp fibres under standard conditions. This provides an indication of the degree of fibrillation (fraying) and hydration (water absorption) of the fibres. More beaten pulp suspensions are more defibrillated and hydrated and the water drains more slowly; the SR value is higher.

Apparatus

Schopper-Riegler test apparatus with 2 special measuring cylinders The cylinders are calibrated in SR such that 1000 ml=0 SR and 0 ml=100 SR. The Schopper-Riegler [SR] apparatus is accepted standard equipment used in the pulp, paper and board making and allied industries measuring the drainage rate of a paper or board making stock and hence the degree of fibrillation and hydration of fibres. The SR devices have to be constructed in a specific method so that the value of identically defibrillated fibres will be consistent when measured with any calibrated SR apparatus of any brands/make including 1 liter measuring cylinder, Mercury in glass thermometer and a Jug (approx 1 liter). The Schopper-Riegler apparatus was checked daily before use as follows:

1. Place the 2 special measuring cylinders under the rear orifices of the Schopper-Riegler tester.
2. Rinse the apparatus with water 20° C. Ensure that the body of the apparatus is correctly positioned. Lower the sealing cone by means of handle. Pour 1 liter of tap or de-ionised water into the body of the tester. If water leaks from the apparatus the position of the sealing cone requires adjusting. Discard the water, adjust the sealing cone and re-test.
3. Press the release lever and wait for all the water to drain.
4. Check the SR number corresponding to the volume of water collected in the cylinder from the front orifice. This should be 4.
5. If the SR value of the water is greater than 4, clean the wire in the body thoroughly, check the temperature and the water used and re-test. The wire may be cleaned using acetone and a soft brush, followed by thorough rinsing.

The Test Method used was as follows in which the following steps were used:

1. Calculate the exact solid content of the co-rotating twin screw refined stock via Metler Toledo HG53-P Moisture Analyzer or any other recognised standard method for moisture determination.
2. Take the equivalent of 2 dry grams of twin screw refined stock, add to 500 ml of tap water, stir with magnetic stirrer and sonicate with the aid of a standard sonicator or disintegrate with the aid of a standard pulp disintegrator until complete fibre dispersion has been achieved.
3. Check the temperature of the water and pulp suspension, and adjust to 20±0.5° C. if necessary, before carrying out this test.
4. Position the two cylinders as described above. Ensure that the body is correctly positioned and lower the sealing cone suing the handle.
5. Ensure that the stock solution is thoroughly mixed and then measure the volume calculated in step 2. Dilute to 1000 ml with water at 20° C.
6. Mix the pulp stock thoroughly and pour rapidly and smoothly into the body. Pour the stock against the shaft and wings of the sealing cone to avoid a vortex.
7. Raise the sealing cone 5 seconds after all the stock was added, by pressing the release lever.
8. When the water has finished draining, record on the SOP PTS the SR value equivalent to the volume of water collected from the front orifice.
9. Remove the body of the SR, and wash all fibres from the wire. Empty and replace the cylinders.
10. Repeat the test (steps 1 to 9) with a second portion of stock.

11. If the two readings differ by more than 4% (1 unit for SR value of 25), repeat the measurement using another portion of pulp. The two closest values are then used.

The mean of the two readings is then calculated and a report of the SR value to the nearest whole number is provided.

A first example of an aspect of the invention is now provided in which a twin screw apparatus is used and the method according to the invention is performed with a co-rotating intermeshing twin screw as the twin screw refining system. The laboratory trials have been carried out using a twin screw refining system which is a conventional twin screw apparatus, co-rotating and intermeshing. The barrel internal diameter is 24 mm. The screw outer diameter (OD) is 23.6 mm and the screw internal diameter (ID) is 13.3 mm. The Centre Line Distance is 18.75 mm. The pitch is positive with respect to rotation, although negative elements can be used. The screw design is a bi-lobal type. The configuration of this twin screw is given in Table 1 below. The Table 1 gives the number and type of screw elements of each screw in successive order from the inlet side—upper side of table—to the outlet side—lower side of table—of the screw. From this table follows that the total L/D ratio of the screw is 40:1 and that the diameter D of each screw element is 23.6 mm and the diameter of barrel is 24 mm. The apparatus is usually [by the skilled man] referred to as a "24 mm" extruder.

TABLE 1

Configuration of twin screw refining system.

| Number | Type | L/D (length/ diameter ratio) | Cumulative Total L/D ratio |
|---|---|---|---|
| 6 | 1 D FS (Diameter Feed Screw) | 6 | 6 |
| 2 | 60 F | 0.5 | 6.5 |
| 1 | D/2 60 F | 0.5 | 7 |
| 1 | D/2 30 F | 0.5 | 7.5 |
| 2 | D/2 90 A | 1 | 8.5 |
| 6 | 1 D FS | 6 | 14.5 |
| 1 | D/2 30F | 0.5 | 15 |
| 7 | 30 F | 1.75 | 16.75 |
| 7 | D/2 60F | 3.5 | 20.25 |
| 9 | 1 D FS | 9 | 29.25 |
| 2 | 30 F | 0.5 | 29.75 |
| 1 | D/2 30F | 0.5 | 30.25 |
| 6 | 30 F | 1.5 | 31.75 |
| 6 | 90 A | 1.5 | 33.25 |
| 5 | 1 D FS | 5 | 38.25 |
| 1 | Alpha Beta D/4 | 0.25 | 38.5 |
| 1 | 1.5 D EXT | 1.5 | 40 |

Concerning the nomenclature used for the type indications in Table 1 above:

D stands for Diameter; FS stands for Feed Screw; F stands for Forwarding; A stands for Alternating; Alpha-Beta is transition element between the bi-lobal elements and the final pressure generating uni-lobal discharge screw; EXT stands for Extrusion screw; D/2 stands for half the diameter; D/4 stands for quarter of Diameter; the numbers 1, 1.5 are overall L/D ratios of the elements, 30, 60, 90 are the angle in degrees between consecutive mixing elements.

In a further example of the invention there is provided a method whereby the energy usage to refine a cellulosic material suspension in water to a de-fibrillated pulp having an increased internal fibre surface and an increased degree of interlinking is described.

The Tables below show energy usage to refine cellulose-containing and fibrous material to microfiber pulp having an increased internal fibre surface and an increased degree of interlinking, and having properties as described in the above detailed description.

TABLE 2

Energy usage to refine cellulose-containing and fibrous material to 75 SR having an increased internal fibre surface and an increased degree of interlinking via a Voith double disk refiner technology (the "traditional" technology).

| Type of fibrous material | Energy Usage kWh/kg |
|---|---|
| Recycled White paper | 1.539 kWh/kg (0.520 kWh/kg) |
| Bleached Hemp pulp (Celesa) | 1.628 kWh/kg (0.782 kWh/kg) |
| Hard wood Kraft pulp (*Eucalyptus*) | 1.569 kWh/kg (0.700 kWh/kg) |

All the values shown represent the gross Specific Refining energy. The NET energy values for the double disk refiner are shown in brackets ( ).

TABLE 3

Energy usage to refine cellulosic fibrous material to 75SR having an increased internal fibre surface and an increased degree of interlinking via twin screw technology.

| Type of fibrous material | Energy Usage kWh/kg Twin screw refiner | Energy Usage kWh/kg Voith double disk refiner |
|---|---|---|
| Recycled best white paper | 0.218 | 1.539 kWh/kg (0.520 kWh/kg) |
| Mixed coloured waste paper | 0.218 | N/A |
| Soft Wood Kraft Pulp | 0.236 | N/A |

All the values shown represent the GROSS Specific Refining energy. Difference between NET and GROSS specific refining energy has shown to be considerably larger for the disk refiner than for the twin screw refiner where such difference is negligible. The NET energy values for the double disk refiner are shown in brackets ( ).

Power (in Watts) is equal to SPEED×TORQUE. SPECIFIC ENERGY (mechanical) is power divided by output. Power consumption measurements: Power (in kW)=Torque (in Nm displayed on the "23 mm" co-rotating twin screw apparatus)×SS (screw speed) divided by maximum SS and torque.

As can be witnessed from the above tables, it has now become possible, in comparison to the methods in the prior art, to refine cellulose fibres to a high degree of de-fibrillation having an increased internal fibre surface and an increased degree of interlinking, and having properties as described in the above detailed description, with reduced energy requirement. This allows for a more economically feasible and continuous production of such materials according to the invention.

The next Example now describes a method of preparing refined fibre compositions according to the invention and there is provided a step by step description as to how 1 kg of white recycled paper is processed to the desired refining levels using a co-rotating twin screw apparatus:

1. 1 kg of R12 (best white paper) is mixed with an aqueous solution (i.e. tap water) to a consistency of 45%. The mixing with the aqueous solution/liquid may be performed by any means known to the skilled person, however preferably, preparing the pulp is achieved by feeding the composition comprising cellulose fibres to a first twin screw that is fitted with a water (or steam) feed system, preferably a metered water feed system. In the twin screw the liquid and the composition comprising cellulose fibres are processed into a pulp. Preferably a counter rotating twin screw is applied in this step of the method to soften (lubricate) the fibres thereby minimising fibre damage.

2. The mixed material is manually introduced in the co-rotating twin screw (the characteristics and layout of which has been described in the previous example) at a feed rate of 3 kg/hour. The co-rotating twin screw operates at a rotational speed of 250 rpm and at a fixed temperature of 50° C.
3. The material "passed" one time through the co-rotating twin screw refiner is collected and fed through a second time.
4. The material is "passed" a second time through the co-rotating twin screw refiner and the resulting product is collected and fed through a third and final time.
5. The refining level of the co-rotating twin screw refined material is tested after each pass via the Schopper-Riegler (SR) method.

In the next example there is provided examples of microfibre compositions produced in a method comprising the method according to the invention. Results obtained with various materials are shown in Table 4 below.

TABLE 5

Details regarding examples of twin screw refined material, obtained as described above.

| Fibre Type | Solid Content (%) | Pass # | SR value/ °SR | Density/ $kgm^{-3}$ |
|---|---|---|---|---|
| White waste paper | 45% | 1 | 73 | 921 |
| White waste paper | 45% | 2 | 81.5 | 1230 |
| White waste paper | 45% | 3 | 82.5 | 1270 |
| White waste paper | 45% | 4 | 69.5 | 1340 |
| White waste paper | 45% | 5 | 56 | 1330 |
| Mixed Coloured Paper | 45% | 1 | 65 | 1170 |
| Mixed Coloured Paper | 45% | 2 | 71.5 | 1260 |
| Mixed Coloured Paper | 45% | 3 | 76 | 1370 |
| Mixed Coloured Paper | 45% | 4 | 74 | 1420 |
| Mixed Coloured Paper | 45% | 5 | 72 | 1450 |
| Soft Wood Kraft Pulp | 45% | 1 | 72 | 1110 |
| Soft Wood Kraft Pulp | 45% | 2 | 78 | 1130 |
| Soft Wood Kraft Pulp | 45% | 3 | 72 | 1230 |

Using a known technology, namely a twin screw extrusion machine, in a novel way to defibrillate (refine) cellulosic feedstocks to produce a range of papers, boards.

Referring to FIG. 3, in the experiments with the twin screw refining equipment it has been found that the Schopper-Rie-

| Stage | Process Description | Equipment Type |
|---|---|---|
| 1 | Fibre Preparation. Raw fibre reduction and transport system to prepare fibre for entry into the following Twin Screw 1. If feasible, buffer storage facilities should be created. | Paper shredder with interchangeable hammer mill suitable for pre-preparing long fibred pulps (hemp, flax, cotton, abaca) and flash dried pulps, linked to extraneous (contrary) material separation (wood, metal, stones, plastic, etc) and cleaning system including dust removal. Separate line to deal with conventional dry sheet pulp (e.g. bleached softwood kraft, bleached hemp, bleached hardwood) involving a suitable dry disintegration process. |
| 2 | Twin Screw 1. (Feeding System) Fibre reduction system capable of producing fibre suitable for de-fibrillisation in a second twin screw. | Counter rotating twin screw with a metered water and/or steam feed system to soften (lubricate) fibres during the reduction period thereby minimising fibre damage. |

| Stage | Process Description | Equipment Type and additional details of the various parameters used. |
|---|---|---|
| 3 | Twin Screw 2. Process material produced in Stage 2. Refining stage capable of creating material having the characteristics as defined in the claims and description from prepared fibre stock. Where appropriate this stage should also be capable of inducing and collecting liquid extracts from the fibres during the refining process as well as venting volatiles. | Co- rotating twin screw 'refiner'. Configuration twin screw refiner as described herein. Operational speed: 250 RPM Operational temperature: 50 C. Properties and characteristics of a number of fibrous materials processed via twin screw refiner are shown below. Energy usage for a selection of fibrous materials processed via twin screw refiner are given in Table 2 above. This twin screw unit is able to accept a metered amount of water and/or low pressure steam. It is possible to heat the barrel or, in certain cases, cool it. It is envisaged that a maximum temperature of 150° C. will be employed with cooling facility able to bring the temperature down to ambient. A screw speed range from 10 up to 500 rpm (the screw speed of the apparatus can be altered depending of processing needs) is suitable. |

gler degree will begin to fall after reaching a maximum value. This maximum value will depend upon the type of cellulosic material being processed. For the purpose of the examples given above covering the use of this equipment in the pulp, paper, board and allied industries it is only the ascending part of the curve which is of interest. This is not the case when considering the production of floor tiles, wall boards and high strength sheet material, and similar products which are outside the scope of this patent.

The decrease in the Schopper-Riegler is thought to be due to the formation of fibrous debris as the mechanical action progressively destroys the fibres. The example shown in FIG. 3 is the 'refining curve' for white waste paper. The sheet density reaches a maximum but does not begin to decrease in line with the refining curve.

The method gives significant energy and time saving when compared to traditional defibrillating methods, for example, single disc, multi-disc, or conical refiners. There is much less water involved in the twin screw refining process compared to traditional beating or refining methods. The paper or board which is formed can be used for many different purposes such as, for example, writing, printing, graphics, for packing purposes.

The invention claimed is:

1. Method for the treatment of a composition comprising cellulose fibres into a composition comprising cellulose microfibers characterized in that the method comprises the steps of:

a) Providing a composition comprising cellulose fibres;

b) Admixing aqueous solvent to said composition comprising cellulose fibres to provide a pulp suspension comprising cellulose fibres;

c) Feeding said pulp suspension comprising cellulose fibres into a refining step comprising a mechanical fibrillation process executed using a refining co-rotating twin screw;

d) Refining said pulp suspension comprising cellulose fibres with at least the use of said refining twin screw, to provide a composition comprising cellulose microfibers; and wherein said obtained composition comprising relined cellulose fibres at the end of the refining step, can be formed into a range of papers, boards, and further wherein the composition comprising refined cellulose fibres has a Schopper-Riegler value (SR) upon leaving the twin-screw of step c), of at least 35 SR.

2. Method according to claim 1 wherein in step b) a pulp suspension is provided with a consistency of at least 30%, preferably between, and including 40% and 60%.

3. Method according to claim 1 wherein the composition comprising refined cellulose fibres has a Schopper-Riegler value (SR) upon leaving the twin-screw of step c), of at least between −35 and 75 SR.

4. Method according to claim 1 wherein the composition comprising cellulose fibres of step a) is selected from the group consisting of paper, waste paper, recycled paper and pulps made from, but not confined to, softwoods, hardwoods, hemp, flax, cotton linters, abaca, wood waste, cereal straws, bagasse and bamboo.

5. Method according to claim 1 wherein the refining twin screw is a co-rotating or counter rotating twin screw unit.

6. Method according to claim 1 wherein said composition comprising refined cellulose fibres is formed into a 2 dimensional shapes.

* * * * *